US009314801B2

(12) United States Patent
Glunk et al.

(10) Patent No.: US 9,314,801 B2
(45) Date of Patent: Apr. 19, 2016

(54) SHOWER HEAD

(71) Applicant: Hansgrohe SE, Schiltach (DE)

(72) Inventors: Guenter Glunk, Fluorn-Winzeln (DE); Fabian Melle, Ortenberg (DE)

(73) Assignee: Hansgrohe SE, Schiltach (DE)

( * ) Notice: Subject to any disclaimer, the term of this patent is extended or adjusted under 35 U.S.C. 154(b) by 241 days.

(21) Appl. No.: 14/030,491

(22) Filed: Sep. 18, 2013

(65) Prior Publication Data

US 2014/0084082 A1 Mar. 27, 2014

(30) Foreign Application Priority Data

Sep. 21, 2012 (DE) ..... 10 2012 216 960

(51) Int. Cl.
*B05B 1/18* (2006.01)
*B05B 1/16* (2006.01)

(52) U.S. Cl.
CPC ..... *B05B 1/185* (2013.01); *B05B 1/1636* (2013.01); *B05B 1/18* (2013.01)

(58) Field of Classification Search
USPC ..... 239/447, 436, 437, 438, 440, 441, 443, 239/446, 448, 449
See application file for complete search history.

(56) References Cited

U.S. PATENT DOCUMENTS 5,467,927 A * 11/1995 Lee ..... A61H 23/04 239/383
6,079,747 A * 6/2000 Winsor ..... A63C 17/20 280/811
6,164,566 A * 12/2000 Hui-Chen ..... B05B 1/1645 239/383
6,290,147 B1 * 9/2001 Bertrand ..... B05B 1/1618 239/444
7,111,795 B2 * 9/2006 Thong ..... B05B 1/1636 239/222.15
7,552,879 B2 * 6/2009 Nagata ..... E03C 1/08 239/428.5
7,913,934 B2 3/2011 Schorn

FOREIGN PATENT DOCUMENTS

| | | | |
|---|---|---|---|
| CN | 201042681 | Y | 4/2008 |
| CN | 202224260 | U | 5/2012 |
| DE | 2235217 | A | 2/1973 |
| DE | 9011751 | U1 | 11/1990 |
| DE | 4326796 | A1 | 2/1995 |
| DE | 10311383 | A1 | 9/2004 |
| DE | 202010005256 | U1 | 6/2011 |
| JP | 2001303635 | A | 10/2001 |

OTHER PUBLICATIONS

Office action dated Oct. 6, 2013 ins DE 10 2012 216 960.1.
Translation of CN official action dated Sep. 6, 2015 in CN application 201310532315.6, filed Sep. 21, 2013.

* cited by examiner

*Primary Examiner* — Justin Jonaitis
(74) *Attorney, Agent, or Firm* — Duane Morris LLP

(57) ABSTRACT

The invention proposes a shower head, in particular for showers that are fixed in position, for example an overhead shower. The shower head has various options for the water to exit the jet disk. A switching device is provided to engage these different options individually or in combination. This may function in a way known as such with the use of sloping surfaces that slide along one another. The jet disk itself serves to actuate the switching device, and pressure is exerted by the user in the direction opposite that in which the water jets exit.

14 Claims, 5 Drawing Sheets

SHOWER HEAD

Figure 1:
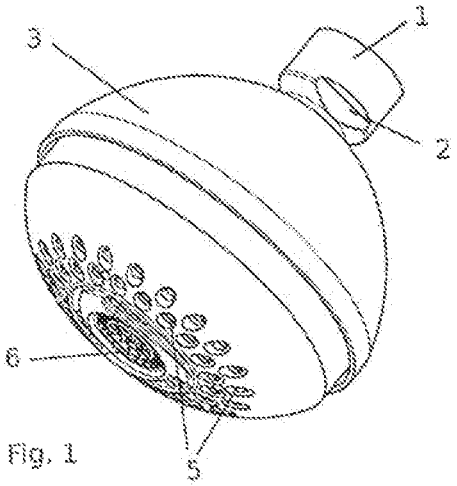

The invention relates to a shower head having a means of switching between two jet exit options of delivery of the jet or jets by the shower head.

It is known that two different types of jet can be delivered by shower heads, for example a soft aerated jet and a hard massage jet. A further known possibility is for the number of active jet exit openings to be changeable. For this it is necessary to have a switching device that has to be actuated manually.

Pressbuttons on the shower head housing are known for the actuation of such switching devices, and for example can be actuated radially inwardly. It is similarly known to provide rotary rings which a user can grip and can actuate through turning.

With shower heads that are a fixed installation, for example overhead showers, there may be the problem that a user cannot find the actuation element for the switching device at the first attempt. This is in particular the case if the user has soapy hands so that they slip from the actuation element.

Utility model publication DE 20 2010 005 256 U1 discloses a hand shower in which the jet disk forms the bottom part of a chamber provided in a shower head housing and having one or more chamber regions. The chamber is pivotably mounted with the jet disk as a rocker switch in the shower head housing for selectively setting one of a plurality of possible jet shapes. Each jet shape corresponds to a specific rocker position of the jet disk with its chamber adjacent to its inner face relative to the shower head housing. Therefore, in case of this hand shower the jet disk is differently positioned for each of the different possible jet shapes.

It is an object of the invention to provide a means of switching between different jet exit possibilities for a shower head with very simple actuation.

To achieve this object the invention proposes a novel shower head with the features given in the independent claims. The subclaims deal with further developments of the invention.

According to the invention the jet disk itself or the shower head functions as the actuation element. The jet disk is in most cases fairly flat or slightly curved so that there is no danger of soapy fingers slipping off. The jet disk is moreover large in most cases so that it is easy to locate. This yields a new and appropriate way of actuating a switching device within the shower head.

According to one aspect of the invention it is provided for the jet disk to return to its starting position after actuation of the switching device. For actuating of the switching device again the jet disk is pressed again.

According to another aspect of the invention the switching device is configured as an advancing switching device so that after each actuation of the jet disk it is switched to the next position, i.e., there is no to and fro switching but instead a further switching. This is of particular value if more than two jet exit possibilities are provided.

One example of the different jet exit possibilities is that air is added to the jet through actuation of the switching device, the air being drawn in at a suitable point. In this case the switching device would influence a valve to an air intake opening. The jet or the plurality of jets can then exit through the same opening.

A further possibility is that a second water line is opened through the switching device so that after actuation the jets exit through a greater number of jet exit openings. For example a saving setting could be provided in which the jets only exit through every second jet exit opening, whilst after switching the jets exit through all jet exit openings.

The invention proposes several possibilities with regard to actuation of the switching device as to how the user exerts pressure on the jet disk.

A first possibility is that the jet disk is arranged so that it can be displaced relative to the shower head housing and acts through this displacement directly or via a gearing on the switching device, for example a valve. The valve may be any of the known valves of the usual design.

A further possibility proposed by the invention is that the shower head housing together with the jet disk are formed so that they are displaceable relative to the inlet connection. This displacement acts directly or indirectly, via a gearing, on the switching device.

A linear movement along the longitudinal axis of the shower head/along a central perpendicular relative to the jet disk is preferred.

A further possibility proposed by the invention is that the jet disk is deformable so that the pressure exerted by the user on the jet disk leads to a deformation of the jet disk which returns to its previous shape after it has been released. This deformability, which can be restricted spatially, enables the user to act on the valve device, for example on a plunger of the valve device.

Another possibility proposed by the invention of actuating the switching device through gripping of the jet disk is for the jet disk to be tiltably mounted in the housing. It may thereby tilt about a fixed axis or about a central punctiform supporting point.

Depending on the arrangement it may be provided for the jet disk to remain in the displaced position until, through a second touching or pressing action, it returns to its starting position.

Figure 2:
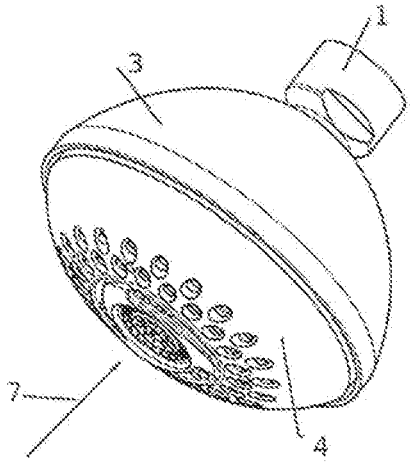
Figure 3:
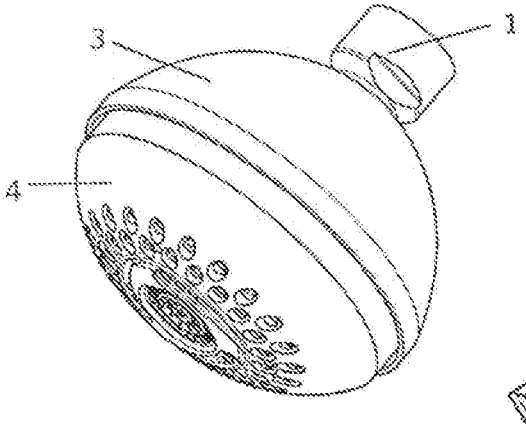
Figure 4:
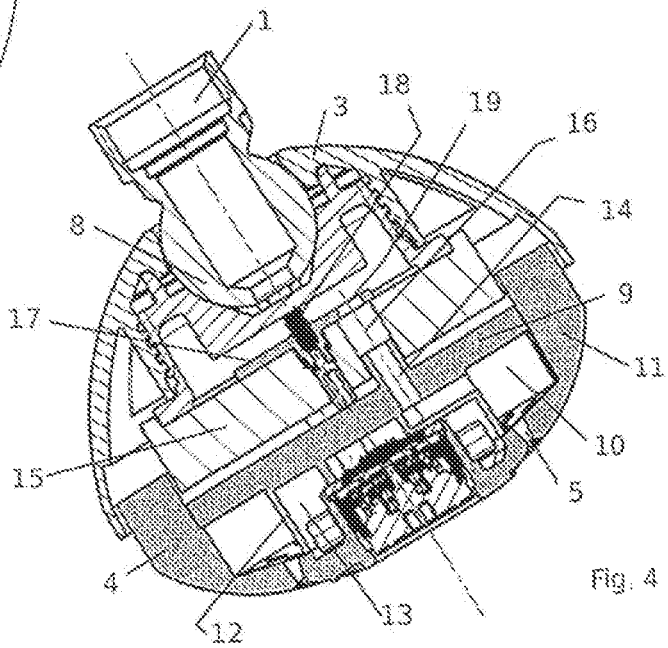
Figure 5:
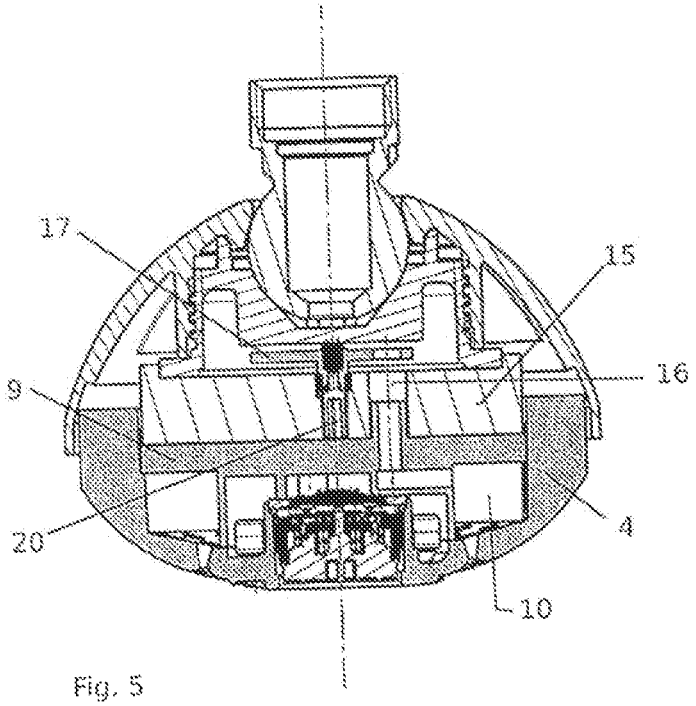
Figure 6:
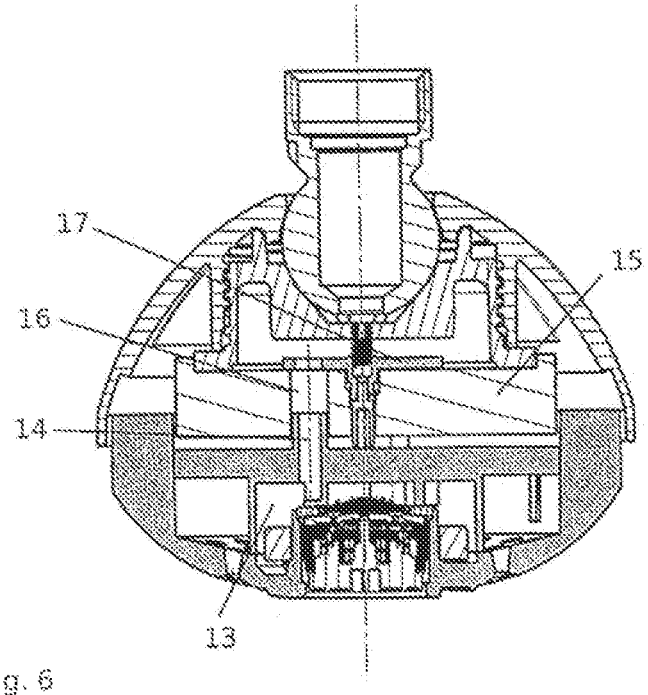
Figure 7:
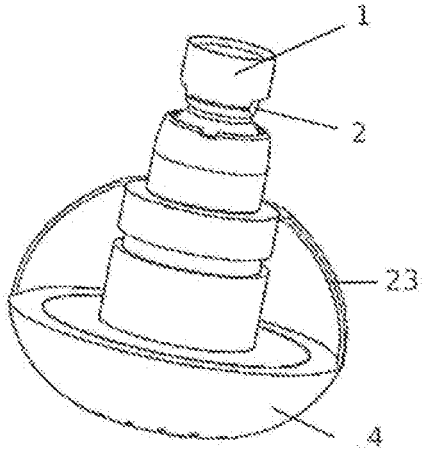
Figure 8:
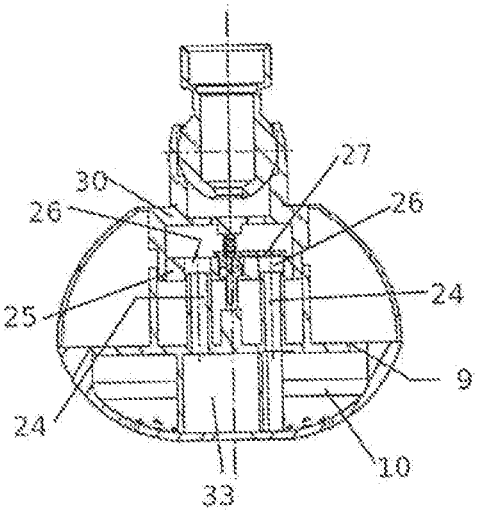
Figure 9:
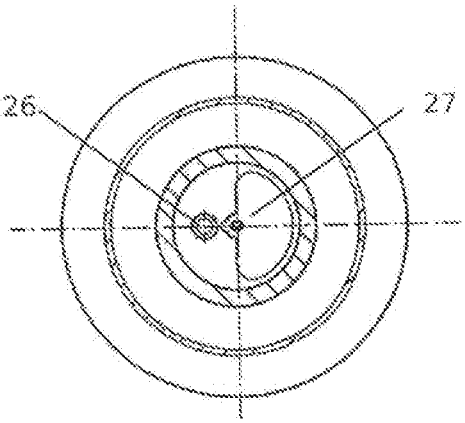
Figure 10:
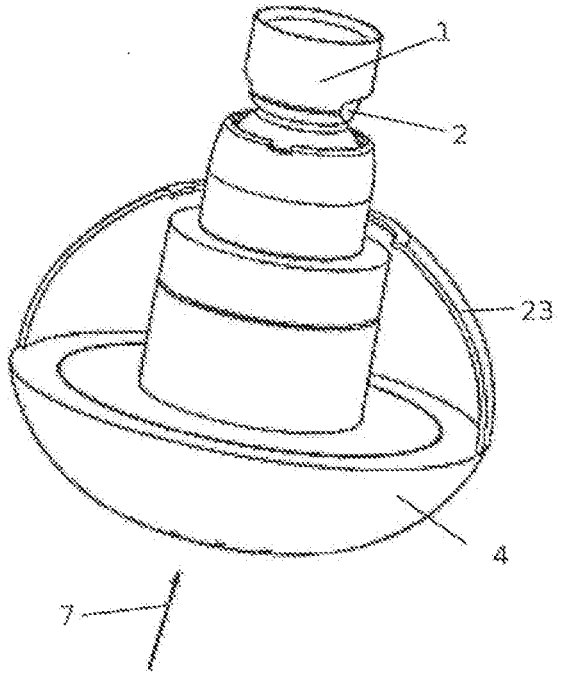
Figure 11:
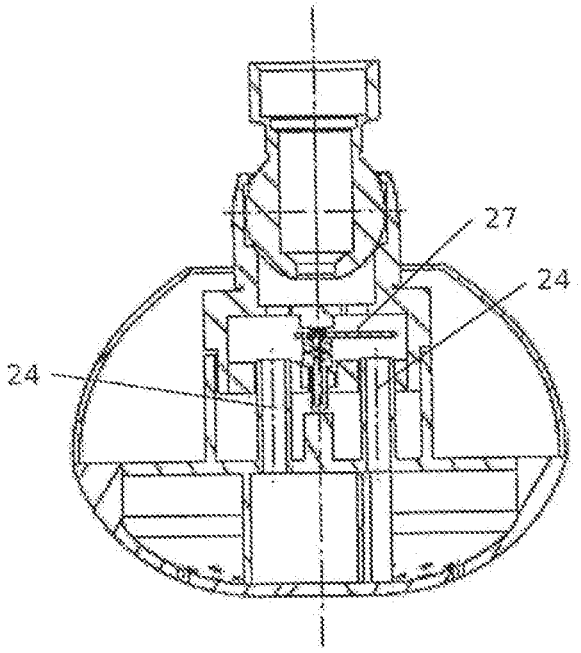
Figure 12:
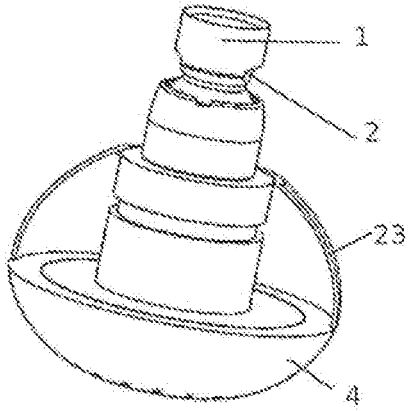
Figure 13:
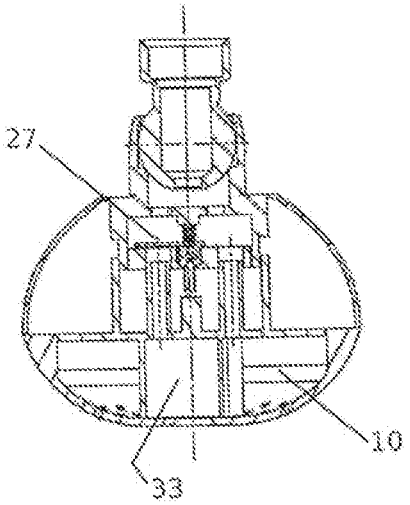
Figure 14:
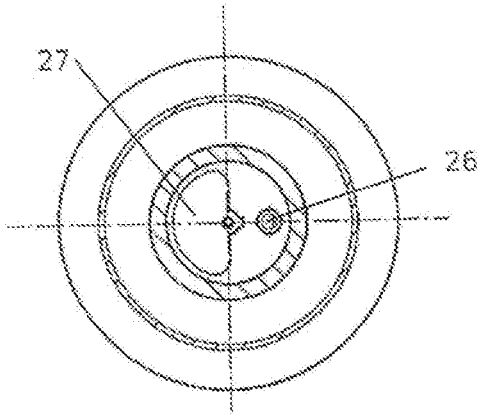

Further features, individual details and advantages of the invention are derived from the claims, the wording of which is incorporated into the description by reference, from the following description of preferred embodiments of the invention, and from the drawings which show the following:

FIG. 1 A perspective view of a shower head according to the invention;

FIG. 2 A perspective view during the switching process;

FIG. 3 A perspective view in the switched state;

FIG. 4 A section through the shower head in a first position according to FIG. 1;

FIG. 5 A section through the shower head during the switching process;

FIG. 6 A section through the shower head in a switched state according to FIG. 3;

FIG. 7 A schematic view of a shower head according to a second embodiment;

FIG. 8 A section through the shower head of FIG. 7 in a first position;

FIG. 9 A cross-section through the shower head of FIG. 7 and FIG. 8;

FIG. 10 The state of switching of the shower head of FIG. 7;

FIG. 11 A section corresponding to FIG. 8 during the switching process;

FIG. 12 A schematic view of the shower head after switching;

FIG. 13 A section corresponding to FIG. 11 in a switched state;

FIG. 14 A section corresponding to FIG. 9 after switching.

FIG. 1 shows a perspective view of a shower head which can be screwed through an inlet connection 1 to the end of a water line. For this purpose the inlet connection has two key surfaces 2. The inlet connection 1 is mechanically connected to a shower head housing 3 that has an approximately hemispherical external shape and which on the anterior side, i.e., on the side facing away from the inlet connection 1, is terminated by a jet disk 4. Two rows of concentrically-arranged jet outlet openings 5 are provided in the jet disk 4, and a second group of jet outlet openings 6 is in the centre.

The jet disk 4 is displaceably mounted in the shower head housing 3 in the direction of the inlet connection 1, i.e., in the direction of a rotational axis of the shower head housing 3. This displacement can be carried out by the user both during the operation of the shower head and when it is not being supplied with water. This is indicated by the arrow 7 in FIG. 2. For switching purposes the user presses the jet disk 4 that can then move into the shower head housing 3. This is shown in FIG. 2. Once the user releases the jet disk 4 again, the disk 4 moves under the influence of a pressure spring disposed in the shower head housing into the position shown in FIG. 1, as shown in FIG. 3.

The section in FIG. 4 shows further details. The water enters the internal part of the shower head housing through the inner part of the inlet connection 1. The shower head housing 3 is pivotably mounted on the spherical internal end 8 of the inlet connection.

The jet disk 4 has a transverse wall 9 at a distance from the posterior side of its anterior wall. A circumferential channel 10 runs as an outer chamber between the transverse wall 9 and the anterior wall of the jet disk, and from which the jet outlet openings 5 mentioned with reference to FIG. 1 emanate. This channel 10 is limited on one side by an outer apron 11 of the jet disk 4 and also by an inner apron 12. A second chamber 13 is formed within the inner apron 12 through which the water can flow out of the shower head housing 3 through the outlet 6.

Two passages are formed in the transverse wall 9, one passage 14 being shown in the section of FIG. 1.

A wall 15 is installed parallel to the jet disk 4 in the shower head housing, through which two passages 16 extend, with only one passage visible in FIG. 4. Each passage 14 in the transverse wall 9 engages with a tubular projection in a passage 16 in the wall 15.

In a central arrangement a valve element 17 lying on the posterior side of the wall 15 is pivotably mounted in the wall 15, wherein in the passage a switching mechanism is formed with interacting sloping surfaces. The valve element 17 is pressed by a pressure spring 18 against the posterior surface of the wall 15. The valve element 17 has a valve opening 19 which in the position shown is aligned with the passage 16. There is consequently a through-flow passage for water between the inlet connection 1 and the chamber 10.

To actuate the switching device the user presses the jet disk 4 in the direction of the arrow 7. As a result, the jet disk 4 is pushed into the shower head housing 3, see FIG. 5, so far that the transverse wall 9 of the jet disk 4 abuts the wall 15. As a result, the valve element 17 is similarly elevated through the afore-mentioned switching mechanism with sloping surfaces, so that the valve element 17 no longer abuts the inner side of the wall 15. Upon release, the pressure spring 18 pushes the jet disk 4 back into its starting position through a plunger 20, and at the same time the valve element 17 rotates because of the arrangement of the sloping surfaces. In the position which results, see FIG. 4, the valve element 17 once again lies on the inner side of the plate 15, but this time its valve opening 19 is flush with the other passage 16 through the wall 15 and with the other passage 14 through the transverse wall 9. This yields a water through-flow passage between the inlet connection 1 and the inner chamber 13.

A switching process thus occurs.

With the embodiment described below with reference to FIGS. 7 to 14, the jet disk 4 is connected to the shower head housing 23. As can be seen from FIG. 8, the jet disk 4 is provided on the inner side of its transverse wall 9 with a telescopic guide device. This comprises a cylindrical projection on the posterior surface of the transverse wall 9 and a cylindrical projection of an intermediate element connected to the inlet connection 1 engaging with this cylindrical projection. A wall 25 is incorporated into this intermediate element 30 which has two passage openings 26, of which one passage opening 26 is connected to a nozzle 24 which leads to an internal chamber 33 of the jet disk. The other passage opening 26 is connected to a nozzle 24 which leads into the outer chamber 10 of the jet disk 4. The valve element 27, see FIG. 9, in the position shown covers one passage 26. The other passage 26 is open. The water flows from the central chamber 33 of the jet disk 4 through the opening there into the open.

If the user now presses the jet disk 4 then this is displaced together with the shower head housing 23 in the direction of the inlet connection, represented by the arrow 7 in FIG. 10. It can also be seen from FIG. 7 that the shower head housing 23 is now closer to the inlet connection 1.

Similarly to the position shown in FIG. 5, the valve element 27 is now lifted off the plate 25. As soon as the user releases it, the spring presses the jet disk 4 together with the shower head housing 23 back into its starting position, with rotation and lowering of the valve element 27 at the same time. In the resultant position, see FIGS. 12 to 14, the valve element 27 covers the other passage 26, and water now flows through the passage 26 shown in FIG. 13 on the right side into the outer chamber 10 of the jet disk 4. Switching has now taken place.

The invention thus proposes a shower head, in particular for showers that are fixed in position, for example an overhead shower. The shower head has various options for the water to exit the jet disk. A switching device is provided to engage these different options individually or in combination. This can function in a known way with the use of sloping surfaces that slide along one another. The jet disk itself serves to actuate the switching device, and pressure is exerted by the user in an opposite direction to that in which the water jets exit.

The invention claimed is:

1. A shower head, comprising:

a shower head housing, an inlet connection for inflow of water into the shower head housing and to secure the shower head housing, a jet disk that closes off the shower head housing and wherein the jet disk has at least one jet exit opening, at least one water-guiding member from the inlet connection to the jet disk in the shower head housing, at least two jet exit options from the jet disk, and a switching device to switch between the jet exit options, wherein the switching device is actuatable through exertion of pressure on the jet disk, wherein the jet disk and the switching device are configured for changing the switching device from one jet exit option to an other jet exit option of the at least two jet exit options by actuation of the switching device through exertion of pressure on the jet disk, and after actuation of the switching device, returning the jet disk to a starting position of the jet disk before actuation of the switching device, while the jet exit option remains at said other jet exit option to which the switching device was changed.

2. The shower head of claim 1, wherein the jet disk is one of axially displaceable, deformable and tiltable by said exertion of pressure on the jet disk.

3. The shower head of claim 2, wherein the showerhead is part of an overhead shower.

4. The shower head according to claim 2, wherein the at least two jet exit options comprise different jet types made possible from at least one same said jet exit opening.

5. The shower head according to claim 2, in which the two jet exit options comprise assignment of water flow to different ones of plural said jet exit openings of the jet disk.

6. The shower head according to claim 1, wherein the at least two jet exit options comprise different jet types made possible from at least one same said jet exit opening.

7. The shower head according to claim 1, in which the two jet exit options comprise assignment of water flow to different ones of plural said jet exit openings of the jet disk.

8. The shower head according to claim 1, wherein the jet disk is mounted displaceably relative to the shower head housing.

9. The shower head according to claim 1, wherein the shower head housing is mounted displaceably relative to the inlet connection.

10. The shower head of claim 1, wherein the showerhead is part of an overhead shower.

11. The shower head of claim 1, wherein the switching device is configured as an advancing switching device operable such that each actuation of the switching device changes the switching device to a next position.

12. The shower head of claim 1, wherein the switching device is configured as an advancing switching device operable such that each actuation of the switching device advances the switching device to a next position.

13. A shower head, comprising:

a shower head housing, an inlet connection for inflow of water into the shower head housing and to secure the shower head housing, a jet disk that closes off the shower head housing and wherein the jet disk has at least one jet exit opening, at least one water-guiding member from the inlet connection to the jet disk in the shower head housing, at least two jet exit options from the jet disk, and a switching device to switch between the jet exit options, wherein the switching device is actuatable through exertion of pressure on the jet disk, wherein the jet disk has a starting position before actuation of the switching device, and is configured upon actuation of the switching device by said exertion of pressure on the jet disk to advance of the switching device to a further jet exit option, and wherein the jet disk returns to the starting position after actuation of the switching device, without additional actuation of the switching device due to a return motion of the jet disk to the starting position, and the switching device remains at the further jet exit option to which the switching device was advanced.

14. A shower head, comprising:

a shower head housing, an inlet connection for inflow of water into the shower head housing and to secure the shower head housing, a jet disk that closes off the shower head housing and wherein the jet disk has at least one jet exit opening, at least one water-guiding member from the inlet connection to the jet disk in the shower head housing, at least two jet exit options from the jet disk, and a switching device to switch between the jet exit options, wherein the switching device is actuatable through exertion of pressure on the jet disk, wherein the switching device is configured to be an advancing switching device which through repeated actuation by exertion of pressure on the jet disk is switched in an advancing manner from a current jet exit option to a next jet exit option, respectively.

* * * * *